United States Patent [19]

Rehm

[11] Patent Number: 4,868,985

[45] Date of Patent: Sep. 26, 1989

[54] UTILITY KNIFE

[76] Inventor: Helmut Rehm, Adlerstrassa 17, 8311 Altfraunhofen, Fed. Rep. of Germany

[21] Appl. No.: 138,298

[22] Filed: Dec. 28, 1987

[30] Foreign Application Priority Data

Jan. 1, 1987 [JP] Japan ..... 62-00001
Apr. 3, 1987 [DE] Fed. Rep. of Germany ..... 8704973

[51] Int. Cl.[4] ..... B67B 7/30; F41B 13/02
[52] U.S. Cl. ..... 30/162; 30/2
[58] Field of Search ..... 30/2, 160, 161, 162, 30/164.9, 280, 290, 317; 83/56, 926 K

[56] References Cited

U.S. PATENT DOCUMENTS 3,906,627 9/1975 Manning ..... 30/162
3,999,290 12/1976 Wood ..... 30/162
4,086,698 5/1978 Sparks ..... 30/2
4,139,939 2/1979 Crooks ..... 30/2
4,523,379 6/1985 Osterhout et al. ..... 30/162
4,683,656 8/1987 Peyrot et al. ..... 30/162
4,713,885 12/1987 Keklak et al. ..... 30/2

FOREIGN PATENT DOCUMENTS 1346481 11/1963 France ..... 30/2

*Primary Examiner*—Frank T. Yost
*Assistant Examiner*—Paul M. Heyrana, Sr.
*Attorney, Agent, or Firm*—Cohen, Pontani & Lieberman

[57] ABSTRACT

A utility knife has a handle housing within which a slide bearing a knife is mounted for longitudinal displacement. Retraction means act on the knife to move it into a protected position. Turnably mounted within the housing (10) is a friction disk (22) which extends out of the handle housing (10) on the cutting-edge side of the knife blade (16). The axis of rotation (24) of said friction disk extends substantially perpendicularly to the plane of the knife blade. A driver member acts on the friction disk which advances the slide together with the knife blade into the cutting position thereof against the force of the retraction means.

11 Claims, 3 Drawing Sheets

FIG. 4
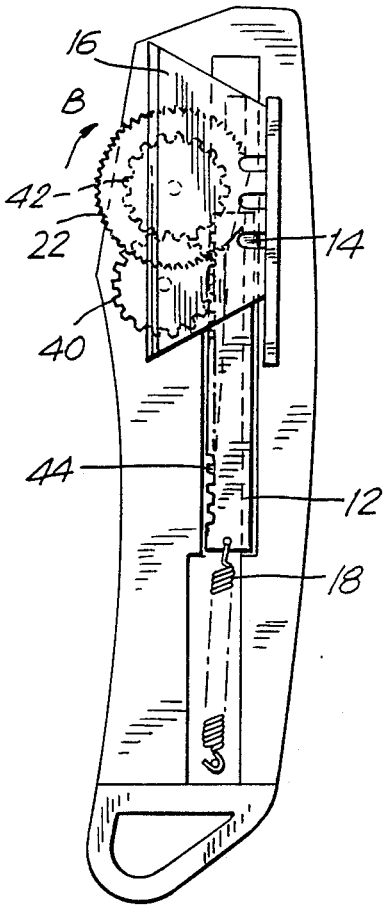
FIG. 5
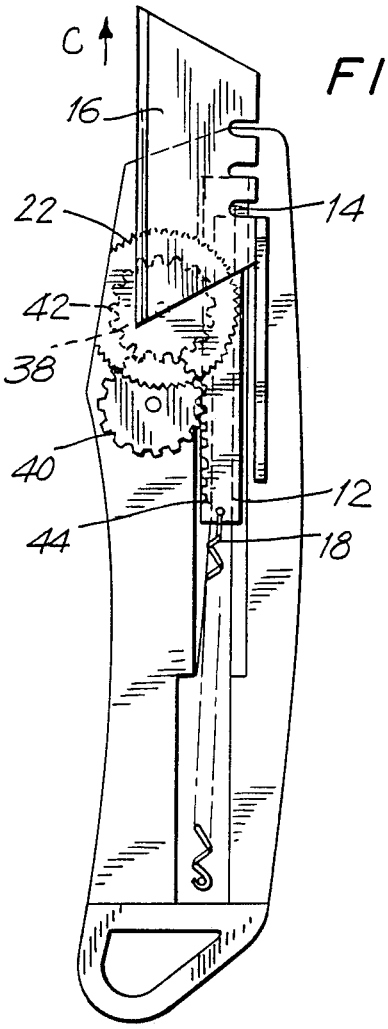
FIG. 10
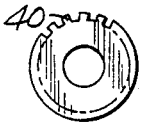
FIG. 8
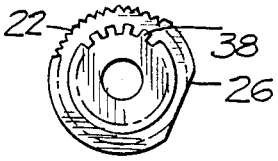
FIG. 6
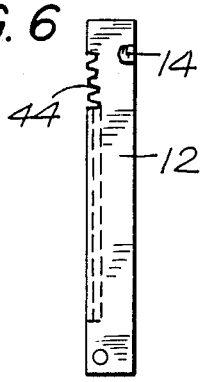
FIG. 7
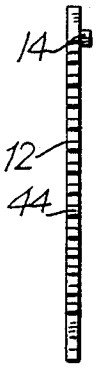
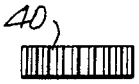
FIG. 11
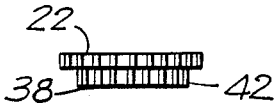
FIG. 9

FIG. 12
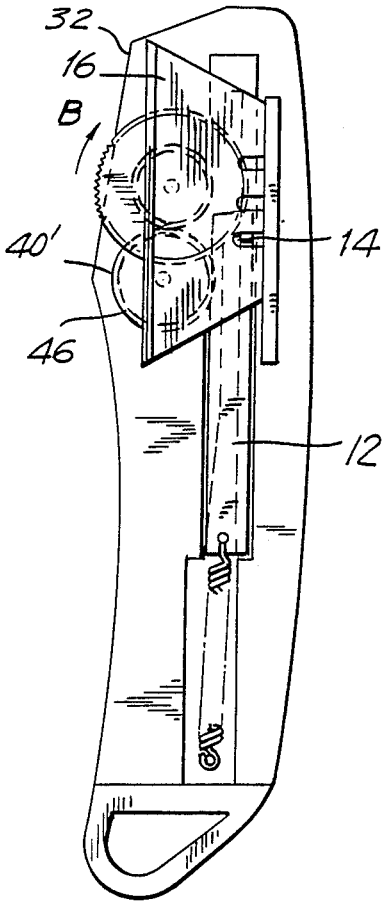
FIG. 13
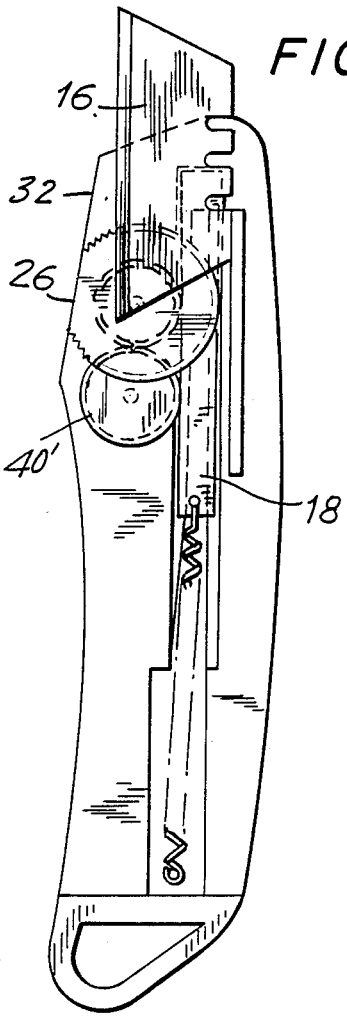
FIG. 17
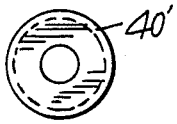
FIG. 15
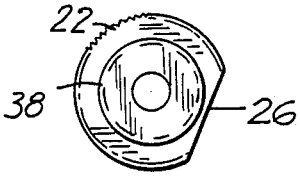
FIG. 14
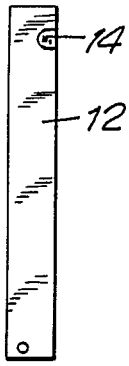
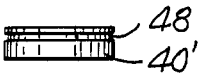
FIG. 18
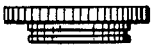
FIG. 16

UTILITY KNIFE

FIELD OF THE INVENTION

The present invention relates to a utility knife having a handle housing within which a slide bearing the knife blade is mounted in longitudinally movable fashion. Specifically, the present invention relates to a utility knife having retracting means for pulling the knife blade back into a protected position within the handle housing.

BACKGROUND OF THE INVENTION

Such utility knives, sometimes called carton knives, may be used for the opening of cartons and similar packages and are intended to prevent accidents by providing that the knife blade is automatically pulled back into its protected position by the force of the return member when the knife is not operating. In order to advance the knife blade into its operating position, the known knives have an outwardly protruding handle piece which can be moved by one's thumb. This way, the operator can push the knife blade outward, which, however, has the disadvantage that upon frequent use during the day, one's thumb becomes tired very rapidly. Consequently, the knife blade is either locked in the operating position by manipulation of the slide or utility knives are used which are not equipped with the safety device described.

DESCRIPTION OF THE INVENTION

One object of the present invention is to create a utility knife wherein the knife blade is automatically advanced into its cutting position at the start of its application to a object to be cut and remains in this position until the end of the cutting operation, whereupon the blade will automatically return into its protected position.

In a utility knife of the above-described construction, this object is achieved in that there is rotatably mounted within the handle housing a friction disk which extends out of the handle housing on the cutting-edge side of the knife blade. The axis of rotation of the disk extends substantially perpendicularly to the plane of the blade. A driver member acting against the friction disc advances the slide together with the knife blade into its cutting position against the force of the retraction means.

During the displacement of the utility knife on the object to be cut, the friction disk carries out a partial revolution whereby the slide and with it the knife blade are brought into the cutting position via the driving member. After the completion of the cutting operation, the retraction means pulls the slide and the knife blade back into the protected position.

Preferably the friction disk is provided on its outer periphery with a flat part which, in the cutting position of the knife blade, extends substantially parallel to the housing edge which lies on the knife-edge side of the knife blade. This way no turning movement is exerted on the friction disk during the cutting process in which the utility knife is pulled along the article to be cut.

The simplest embodiment results when the driver member is a pull wire which is fastened eccentrically to the friction disk. It is also possible to utilize a toothed gearing, a friction-wheel gearing or a belt drive.

The friction disk is preferably knurled on its outer periphery so that dependable rotation around its axis of rotation is assured.

The invention is explained below with reference to embodiments which are shown in the drawings, in which:

FIG. 4 is a view, similar to FIG. 1, of another embodiment of the present invention;

FIG. 5 shows the utility knife of FIG. 4 with the knife blade extended;

FIG. 6 is a view of the slide used in the embodiment of FIGS. 4 and 5;

FIG. 7 is a side view of the slide of FIG. 6;

FIG. 8 is top view of the friction disk used in this embodiment;

FIG. 9 is a side view of the friction disk;

FIG. 10 is a top view of the transfer gearwheel;

FIG. 11 is a side view of the transfer gearwheel;

FIG. 12 is a view similar to FIG. 4 of another modified embodiment with belt drive;

FIG. 13 the utility knife of FIG. 12 with the knife blade extended;

FIG. 14 is a top view of the slide used in this embodiment;

FIG. 15 is a top view of the friction disk used in this embodiment;

FIG. 16 is a side view of the friction disk;

FIG. 17 is a top view of the friction wheel used in this embodiment; and

FIG. 18 is a side view of the friction wheel.

Figure 1:
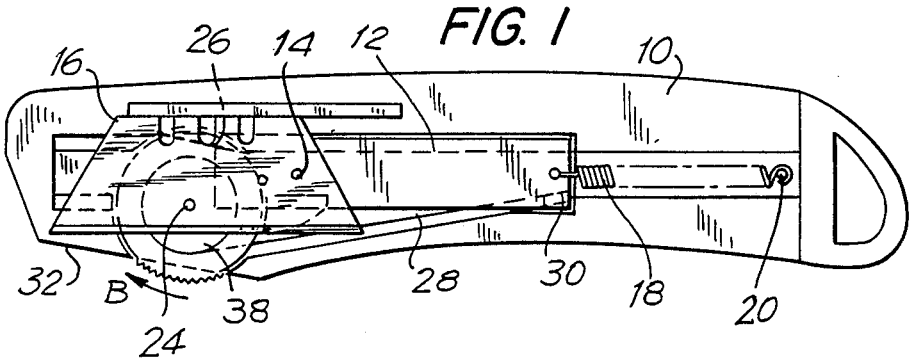
FIG. 1 is a diagrammatic longitudinal sectional view through the utility knife, with the knife blade retracted.
Figure 2:
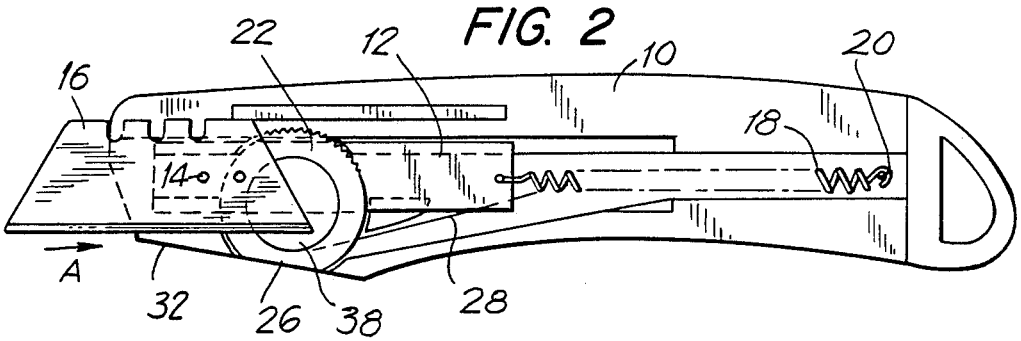
FIG. 2 shows the utility knife with the knife blade advanced into the cutting position.
Figure 3:
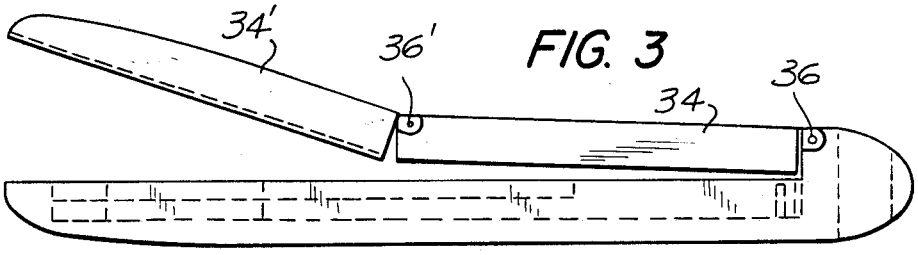
FIG. 3 is a side view with the handle housing swung open.

The utility knife shown in FIGS. 1 to 3 has a handle housing 10 in which a slide 12 is mounted for longitudinal movement in known manner. The slide 12 is provided at one end thereof with a pin 14 on which there is placed a knife blade 16. At the opposing end, a tension spring 18 is connected as retraction means to the slide 12, its other end 20 being fastened in the handle housing 10.

In accordance with the present invention, a flat friction disk 22 which is turnable around an axis 24 extending perpendicularly to the plane of the blade is mounted in the handle housing 10. The friction disk 22 extends out of the handle housing 10 on the cutting-edge side of the knife blade 16. Preferably the greatest part of the outer periphery of the friction disk 22 is knurled, while the remaining part of the outer periphery has a flat 26. A pull wire 28 is fastened to the outer periphery of a cylindrical extension 38 protruding from the friction disk 22, the other end 30 of said wire being fastened to the slide 12.

When the utility knife is placed on an object to be cut, in the condition shown in FIG. 1, i.e. with knife blade 16 retracted into the protected position, the knurled part of the periphery of the friction disk 22 also acts on this object. If the utility knife is then moved in the direction indicated by the arrow A in FIG. 2, the friction disk 22 turns in the direction indicated by the arrow B of FIG. 1 due to the contact with the object to be cut. As a result, the pull wire 28 winds up on the cylindrical extension 38 thereby pulling the slide 12 and with it the knife blade 16 into the cutting position shown in FIG. 2.

During the cutting process the friction disk 22 is recessed in the handle housing 10 since its flat 26 is flush with the housing edge 32 which lies on the cutting-edge side of the knife blade 16.

When, after completion of the cutting operation, the contact between the knife blade 16 and the object to be cut is again eliminated, the spring 18 pulls the slide 12, and with it the knife blade 16, back into the protected position in the handle housing 10.

FIG. 3 shows that the upper part 34, 34' of the handle housing can be swung open by means of the hinge 36, 36' so as to facilitate the replacement of the knife blade 16 or to be able to effect repairs.

In the embodiment shown in FIGS. 4 to 11, a toothed gearing is provided for the transfer of the movement from the friction disk 22 to the slide 12. This gearing has a transfer gearwheel 40 which meshes on the one side with a toothing 42 which is formed on the outer periphery of the cylindrical extension 38 which protrudes from the friction disk 22. On the other side the transfer gearwheel 40 engages with a rack part 44 integrally connected to the slide 12. Upon turning the friction disk 22 in the direction indicated by the arrow B in FIG. 4, the transfer gearwheel 40 is turned in the opposite direction s that the slide 12 is pushed, via its rack part 44, in the direction C, causing the knife blade 16 to move out into the cutting position.

Instead of the toothed gearing, a friction-wheel gearing can also be used. In this case, the transfer gearwheel 40 is formed as a transfer friction wheel 40' which is in engagement both with the cylindrical extension 38 protruding from the friction disk 22 and with the longitudinal edge of the slide 12.

FIGS. 12 to 18 show another modified embodiment in which the driver member is provided with a belt drive. The belt drive has a transfer belt 46 which is wrapped in the form of a FIG. 8 around the cylindrical extension 38 of the friction disk 22 and around the aforementioned transfer friction wheel 40'. For the dependable guidance of the transfer belt 46 both the cylindrical extension 38 and the friction wheel 40' have a circumferential groove 48. The part of the friction wheel 40' adjoining the circumferential groove 48 is in frictional contact with the opposite longitudinal edge of the slide 12 thereby transferring the movement to the slide 12.

What is claimed is:

1. A utility knife comprising a handle housing having an upper and lower edge (32); a slide mounted within said housing for longitudinal displacement; a knife blade having a cutting edge and connected to said slide; retraction means (18) located within said housing for retracting said slide and said knife blade (16) from a cutting position into a protected position in the handle housing; a friction disk (22) turnably mounted within said handle housing (10) and extending out of said handle housing (10) on said cutting-edge side of said knife blade (16); the axis of rotation (24) of said friction disk extending substantially perpendicularly to the plane of said blade; and a driver member for advancing said slide (12) together with said knife blade (16) into the cutting position thereof against the force of the retraction means (18).

2. The utility knife according to claim 1, additionally comprising a flat (26) on the outer circumference of said friction disk (22); said flat being flush, in the cutting position of the knife blade (16), with said lower edge (32) of said housing which lies on said cutting-edge side of said knife blade (16).

3. The utility knife according to claim 1, wherein the friction disk (22) is knurled on its outer periphery.

4. The utility knife according to claim 1, wherein said driver member comprises a pull wire (28) fastened eccentrically to said friction disk (22).

5. The utility knife according to claim 4, additionally comprising a cylindrical extension (38) protruding from said friction disk (22); said pull wire 28 being fastened to the outer periphery of said extension.

6. The utility knife according to claim 1, wherein said driver member comprises a toothed gearing.

7. The utility knife according to claim 6, wherein said toothed gearing comprises a transfer gearwheel (40) a toothing (42) on said friction disk (22) and a rack part (44) on said slide (12); said transfer gearwheel (40) meshing both with said toothing (42) on said friction disk (22) and with said rack part (44) on said slide (12).

8. The utility knife according to claim 1, wherein said driver member is a friction-wheel gearing.

9. The utility knife according to claim 8, wherein said friction-wheel gearing comprises a transfer friction wheel (40') in engagement both with said cylindrical extension (38) protruding from said friction disk (22) and with said slide (12).

10. The utility knife according to claim 1, wherein said drive member comprises a belt drive.

11. The utility knife according to claim 10, further comprising a friction wheel (40') in frictional contact with said slide (12) and wherein said belt drive comprises a transfer belt (46) which is wrapped over s id cylindrical extension (38) protruding from said friction disk (22) and over said friction wheel (40') which is in frictional contact with said slide (12).

* * * * *